US006411264B1

(12) United States Patent
Gustafson

(10) Patent No.: US 6,411,264 B1
(45) Date of Patent: Jun. 25, 2002

(54) TWO-ELEMENT DRIVEN ARRAY WITH IMPROVED TUNING AND MATCHING

(75) Inventor: Eric S. Gustafson, Tucson, AZ (US)

(73) Assignee: Kenneth A. Herschberg, Tucson, AZ (US)

( * ) Notice: Subject to any disclaimer, the term of this patent is extended or adjusted under 35 U.S.C. 154(b) by 0 days.

(21) Appl. No.: 09/715,288

(22) Filed: Nov. 17, 2000

(51) Int. Cl.[7] ..... H01Q 21/12

(52) U.S. Cl. ..... 343/812; 343/792.5; 343/793; 343/814; 343/830; 343/831

(58) Field of Search ..... 343/791, 792, 343/792.5, 793, 801, 802, 812, 813, 814, 821, 830, 831, 850, 853, 795

(56) References Cited

U.S. PATENT DOCUMENTS

| | | | | | |
|---|---|---|---|---|---|
| 2,485,177 | A | | 10/1949 | Wehner | 250/33 |
| 2,487,567 | A | | 11/1949 | Lindenblad | 250/33 |
| 3,139,620 | A | | 6/1964 | Leidy et al. | 343/730 |
| 3,618,103 | A | * | 11/1971 | Ringland | 343/727 |
| 4,131,895 | A | * | 12/1978 | Robinson | 343/792 |
| 4,260,994 | A | * | 4/1981 | Parker | 343/854 |
| 4,491,849 | A | | 1/1985 | Tilston et al. | 343/791 |
| 4,785,308 | A | | 11/1988 | Newcomb | 343/795 |
| 4,829,316 | A | | 5/1989 | Nakasa et al. | 343/792 |
| 5,087,922 | A | | 2/1992 | Tang et al. | 343/814 |
| 5,400,042 | A | * | 3/1995 | Tulintseff | 343/727 |
| 5,489,914 | A | * | 2/1996 | Breed | 343/818 |
| 5,493,306 | A | | 2/1996 | Rudish et al. | 342/271 |
| 5,604,506 | A | | 2/1997 | Rodal | 343/791 |
| 5,771,026 | A | | 6/1998 | Stengel, Jr. | 343/858 |
| 5,841,406 | A | | 11/1998 | Smith | 343/815 |
| 5,966,100 | A | * | 10/1999 | Podger | 343/742 |
| 6,005,530 | A | | 12/1999 | Jovanovich et al. | 343/827 |
| 6,034,648 | A | | 3/2000 | Hope | 343/790 |

* cited by examiner

*Primary Examiner*—Tho G. Phan
(74) *Attorney, Agent, or Firm*—Birdwill Janke & Durando, PLC

(57) ABSTRACT

A two-element driven array with improved tuning and matching. First and second elongate conductive elements are provided having respective feed point gaps disposed substantially at their centers, the second elongate element being substantially coplanar and parallel with the first elongate element and spaced a predetermined distance therefrom. A phasing transmission line is connected between the feed point gap of the first elongate element and the feed point gap of the second elongate element so as to reverse the polarity there between. A variable transmission line having a movable shorting member is connected at one end thereof to the second end of the phasing transmission line. The first end of the phasing transmission line is the feed point for the antenna. A combined balun and impedance matching network is providing for coupling the antenna to an unbalanced, coaxial feed line. The combined network includes a shorting stub to adjust the impedance match between the antenna and the feed line.

18 Claims, 4 Drawing Sheets

Top View

TWO-ELEMENT DRIVEN ARRAY WITH IMPROVED TUNING AND MATCHING

FIELD OF THE INVENTION

This invention relates to radio antennas, and particularly to high-frequency, parallel-element, phased array antennas.

BACKGROUND OF THE INVENTION

In the commercial and amateur, high frequency radio communications art the size and weight of an antenna are often as important, or nearly as important, as its electromagnetic characteristics. This is because, particularly at high frequency wavelengths, the physical dimensions of an antenna may dictate whether it can be used at a particular location and can have a significant impact on the cost of the antenna and its installation. In general, for given gain, directivity, bandwidth and impedance matching characteristics, it is desirable to make an antenna as compact and lightweight as possible. In addition, the electrical characteristics of an antenna are affected by the in situ environment of the antenna, so it must be tuned and its input impedance must be adjusted to account for that environment.

One well known type of antenna that provides high gain and directivity is the planar, parallel-element, phased array antenna. In such an antenna, two or more elongate conductive elements are disposed parallel to one another in the same plane, spaced apart from one another by selected amounts to form an array, and supported by a boom disposed perpendicular to the array elements. The gain and directivity of such antennas is determined primarily by the number of elements, the spacing between the elements and the relative phases of the currents in the elements. One or more of the elements is connected directly to the radio, and others may be coupled indirectly to the radio by electromagnetic field interaction among the elements. Where all the elements of the array are connected directly to the radio the antenna is known as "driven array." (It is well understood in the art that an antenna generally has the same electromagnetic characteristics whether it is "driven" by a radio transmitter or connected to a receiver to receive electromagnetic radiation.) Where not all of the elements of an array are connected directly to the radio, that is, not all elements are "driven," the antenna is known as a "parasitic array," the elements that are connected being referred to as driven, and the elements that are not connected being referred to as parasitic.

The commonly known three-element parasitic phased array, generally known as a three-element "Yagi," can provide excellent gain, directivity and bandwidth characteristics at high frequencies, but cannot be made very compact or lightweight. The more compact and lightweight two-element parasitic array can achieve most of the gain of a three element parasitic array which has been optimized for directivity, but the two-element Yagi cannot simultaneously provide adequate front-to-rear power ratio.

The two element driven array is well known in both the amateur and the commercial radio communications art. It comprises two parallel conductive elements which are spaced a selected distance apart and both of which are connected directly to the radio, usually with a transmission line that presents a different phase to one element than the other element. In particular, there have been a number of popular variants of the two-element driven array in common use by the amateur radio community. These include antennas known as the W8JK array, and various embodiments of unidirectional designs known as the "HB9CV array" or "ZL Special".

All of the aforementioned two-element driven arrays have their strengths and weaknesses. For example, the W8JK array, which uses two equal length elements fed 180 degrees out of phase, is easy to construct and capable of providing a significant amount of bidirectional gain. However, in order to provide a large amount of gain, the elements must be closely spaced, and when spaced as closely as about 0.125 wavelengths or less, the radiation resistance falls precipitously for both elements. As a result, losses become significant. Also, since the antenna is bidirectional, it is less useful for interference rejection than a unidirectional design.

The aforementioned HB9CV array alleviates both the loss and front-to-back power ratio problems of the W8JK antenna by using elements which are not the same length and by operating them at a relative phase angle other than 180 degrees. All known variations of this design are believed to use stagger tuned elements spaced at about 0.125 wavelengths and differ in the phasing and feed methods that are used. An important drawback, however, is that the tuning and input impedance matching of such antennas cannot be adjusted in situ; rather, the antenna must be removed from its in situ support structure, typically a mast, physically adjusted, and then put back in place. This is not only physically awkward, but it often prevents the antenna from being optimally adjusted since the required adjustment is affected by the real environment in which the antenna operates.

Accordingly, there is a need for a relatively compact unidirectional antenna having good front-to-rear performance, high efficiency and reasonable gain whose optimal resonance frequency and input impedance match can be adjusted in situ.

SUMMARY OF THE INVENTION

It has been found that a novel two-element driven array according to the invention can provide at least as much gain as a two-element Yagi together with front-to-rear directivity comparable to that which is available from a three-element Yagi. It has less than half the boom length and only about two thirds the mass of a three element Yagi of similar electromagnetic properties. The novel two-element driven array can be tuned in situ and its input impedance can be adjusted in situ.

To that end, the invention provides an array antenna comprising a first elongate element having a feed point gap disposed substantially at the center thereof, a second elongate element having a feed point gap disposed substantially at the center thereof, the second elongate element being substantially coplanar and parallel with the first elongate element and spaced a predetermined distance therefrom; a phasing transmission line connected at a first end thereof to the feed point gap of the first elongate element and at the second end thereof to the feed point gap of the second elongate element; and a tuning transmission line connected at one end thereof to the second end of the phasing transmission line. The first end of the phasing transmission line is the feed point for the antenna.

The transmission line connected to the second end of the phasing transmission line preferably comprises a variable transmission line having a movable member for shorting one side of the transmission line to the other side thereof for tuning the resonant frequency of the antenna. The phasing transmission line preferably comprises a pair of unbalanced coaxial cables tucked into the boom for protection. A combined balun and impedance matching network is preferable provided for matching the antenna to an unbalanced, coaxial feed line. Combined network preferably includes a shorting stub to adjust the impedance match between the antenna and the feed line.

The two elongate elements are mounted on a boom perpendicular thereto. The tuning transmission line and combined balun and impedance matching network may be folded back on the boom for ease of access in situ.

These features provide an optimum combination of antenna gain, directivity, bandwidth and impedance matching in a compact, lightweight, two-element driven array, together with in situ tuning and impedance match adjustment.

The foregoing and other objects, features, and advantages of the invention will be more readily understood upon consideration of the following detailed description of the invention, taken in conjunction with the accompanying drawings.

DETAILED DESCRIPTION OF THE INVENTION

Figure 1:
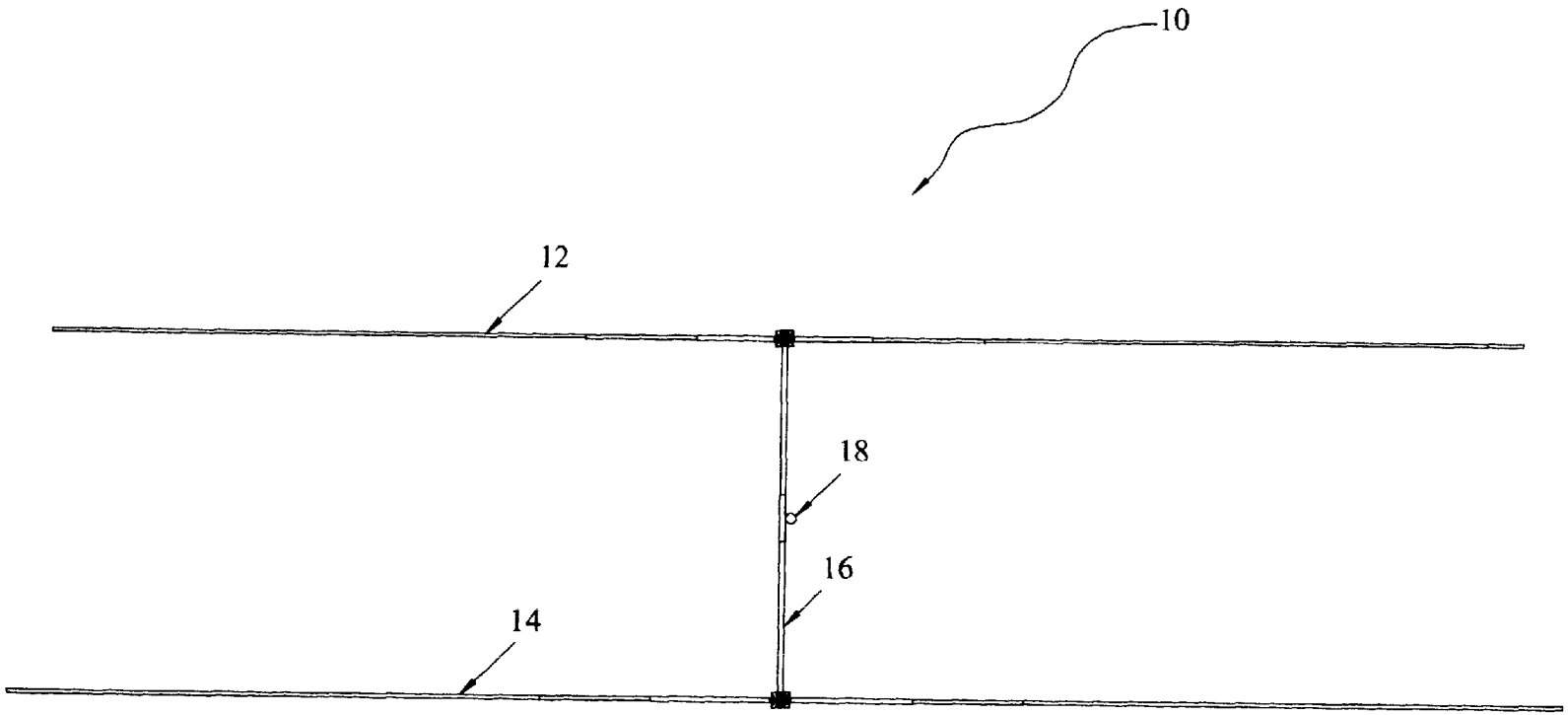
FIG. 1 is an illustrative, top view of a physical manifestation of an antenna according to the present invention.

An illustrative physical manifestation of a two-element, coplanar, parallel element, driven, phased array antenna according to the present invention is shown in FIG. 1. The antenna 10 comprises a first, elongate conductive element 12 and a second, elongate conductive element 14, the second element being substantially coplanar with and parallel to the first element. The elongate elements may each comprise a pair of collinear metal tubes, such as aluminum pipe, joined at one end by an electrically insulating member so as to form a dipole radiator with a center feed point, as is commonly understood in the art. The first and second elongate elements are supported by a boom 16, disposed substantially perpendicular to the elongate elements and attached thereto so as to form a substantially H-shaped antenna structure, as is also commonly understood in the art. Such an antenna is commonly referred to as a two-element beam antenna. Ordinarily the antenna 10 is supported above and substantially parallel to the ground by a mast 18.

Figure 2:
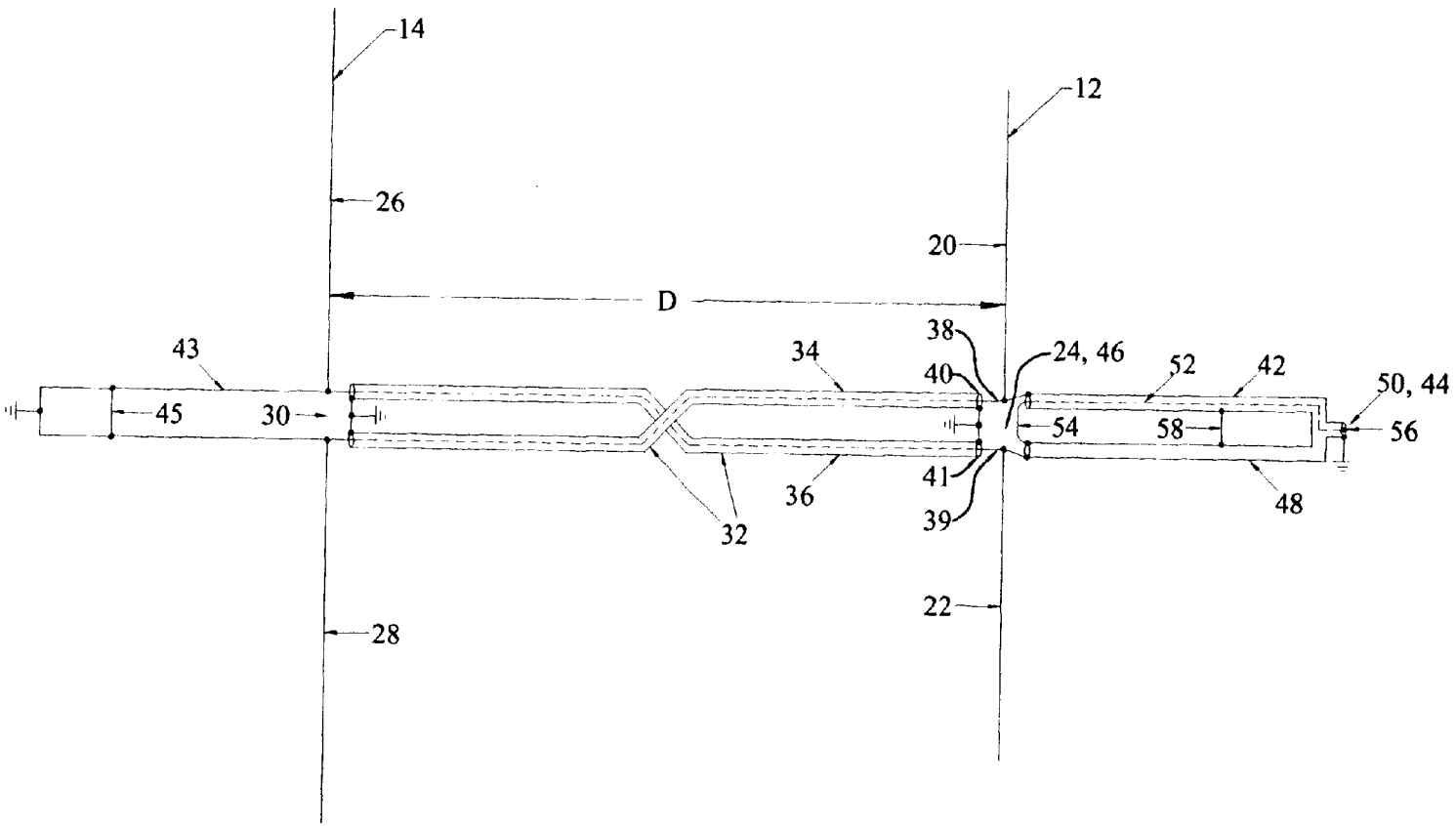
FIG. 2 is a schematic diagram of a preferred embodiment of an antenna according to the present invention.

Turning to FIG. 2, in a preferred embodiment of the invention the first elongate element 12 has a first section 20 and a collinear second section 22 which, together, form a dipole with a feed point gap 24 disposed substantially at the center thereof. Similarly, the second elongate element 14 has a first section 26 and a collinear second section 28 which, together, form a dipole with a feed point gap 30 disposed substantially at the center thereof. The feed point gaps separate the respective elongate element sections by the minimum amount needed to avoid arcing at the power rating of the antenna, as is commonly understood in the art. The first elongate element and the second elongate element are separated by a predetermined distance D, which ordinarily would be substantially about one eighth wavelength of the nominal operating frequency to which the antenna is tuned.

To achieve the desired antenna bandwidth together with optimal gain in the direction extending from the second element toward the first element, front to rear power ratio, and beam width, the first, or "front," and second, or "rear," elongate elements are stagger tuned. That is, the first and second elongate elements are both driven with a predetermined relative phase relationship, and the rear element may be tuned to a different resonant frequency from the front element to provide the desired antenna characteristics.

To produce the forward radiation pattern, the rear elongate element is driven about 139 degrees out of phase with the front elongate element. This is accomplished by connecting the front elongate element to the rear elongate element by a phasing transmission line 32, having a first coaxial element 34 and a second coaxial element 36, and using the front end of the phasing transmission line as the antenna feed point. Both coaxial elements have an inner conductor 38, 39 and an outer conductor 40, 41, as is commonly understood in the art. The inner conductor 38 of the first coaxial element 34 connects one side of the feed point gap 24 of the front elongate element 12 to the other side of the feed point gap 30 of the rear elongate element 14. Similarly, inner conductor 39 of the second coaxial element 36 connects one side of the feed point gap 24 of the front elongate element 12 to the other side of the feed point gap 30 of the rear elongate element 14. Accordingly, the polarity of the phasing transmission line is reversed between the front and rear elongate elements.

Preferably, the first and second coaxial elements 34, 36 are made of 50 ohm coaxial cable, as is commonly known, so that the phasing transmission line may be placed inside and protected by the antenna boom. However, it is to be recognized that other types of transmission line may be employed in the phasing transmission line without departing from the principles of the invention, the object being to achieve the needed phase relationship between the front elongate element and the rear elongate element. The respective outer conductors of the first and second coaxial elements are grounded at each end, as shown in FIG. 2.

A variable transmission line, or "tuning stub," 43, connected to the rear end of the phasing transmission line, is used to tune the antenna. The variable transmission line preferably comprises an open wire, balanced transmission line with a movable shorting member 45 connected from one side to the other thereof so as to short the variable transmission line at a selected position. This is used to adjust the electrical length of the variable transmission line and, accordingly, the resonant frequency of the antenna. Preferably, the end of the variable transmission line opposite the phasing transmission line is grounded for lightening protection, as shown in FIG. 2.

While the antenna could be fed by a balanced transmission line, it is much more practical to feed it with an unbalanced transmission line, preferably the commonly used 50 ohm coaxial transmission line. To that end, the antenna is provided with a "balun" (balanced-unbalanced) input network 42. The balun network has an input port 44 for connection with an unbalance feed transmission line, and an output port 46 for connection to the antenna feed point, that is, the front end of the phasing transmission line 32.

The balun network has a tubular, elongate conductor 48 connected at one end thereof to one side of the feed point of the antenna and at the other end thereof to the other side of the feed point of the antenna, the tubular conductor having an aperture 50 located substantially half the distance between the ends thereof. It also has an elongate center conductor 52 disposed substantially along the axis of one half of the tubular conductor, a first end 54 of the center conductor extending out one end of the tubular conductor and being connected to the other end of the tubular conductor, the second end 56 of the center conductor extending out of the aperture in the tubular conductor. The two ends of the tubular conductor form the output port 46 of the balun network. The tubular conductor at the aperture 50 and the second end 56 of the center conductor form the input port 44 of the balun network.

To match the input impedance of the antenna with the output impedance of a feed transmission line connected to the input port 44 of the balun network, the balun is provided with an adjustable shorting member 58 which connects one half of the tubular conductor to the other half thereof at a selected location between the output port 46 and the input port 44 of the balun network.

The tubular conductor is preferably, but not necessarily, made of substantially cylindrical, hollow tubing wherein the cylindrical tubular conductor 48 and inner conductor 52 of the balun are discrete elements. Alternatively, it may be fashioned from coaxial cable having a dielectric material interposed between the outer tubular or shield conductor, and the inner conductor thereof. In the latter case, the outer insulation of the cable must be removed to expose the shield conductor so that the shorting member may be used.

Figure 3:
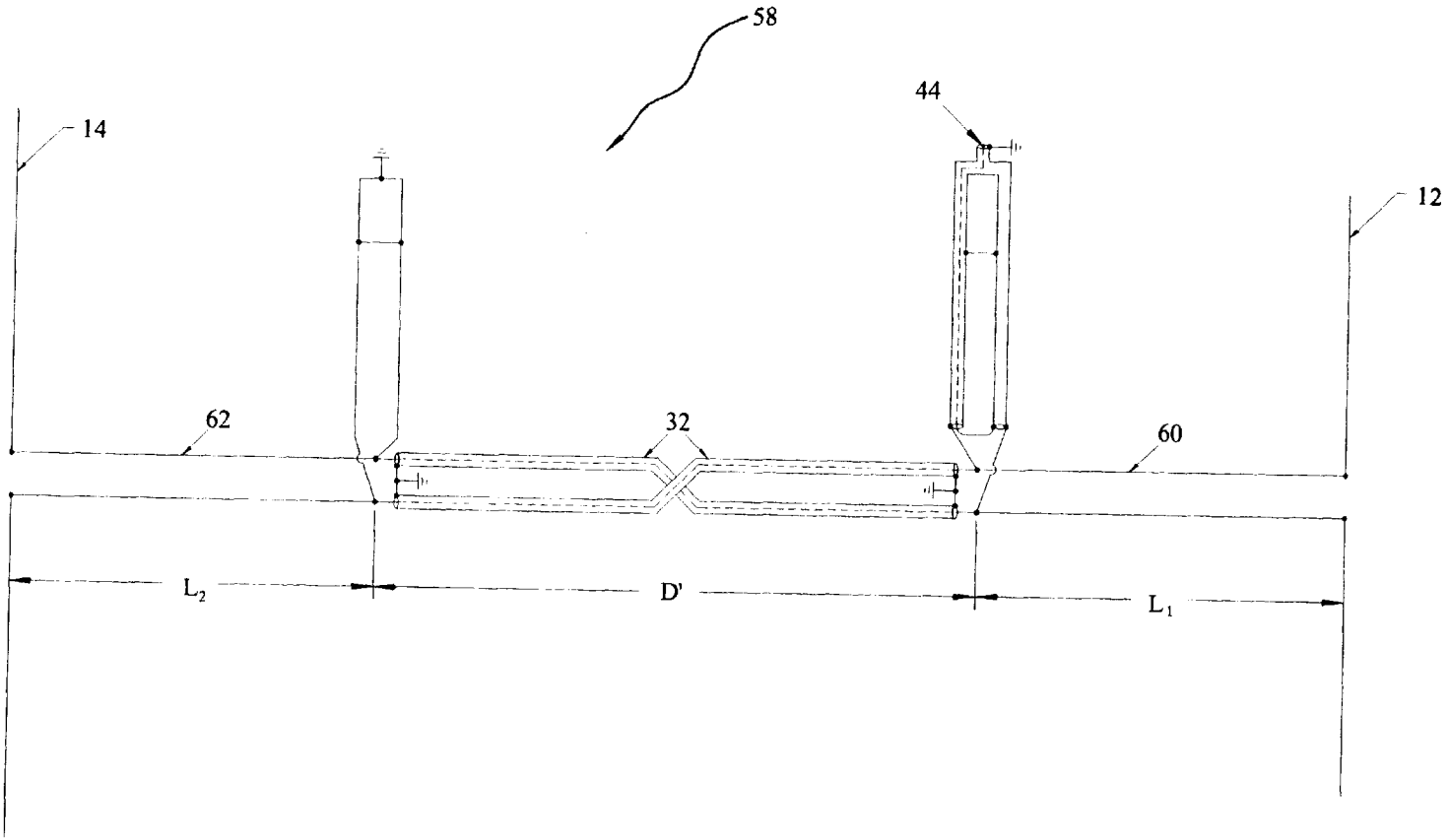
FIG. 3 is a schematic diagram of an alternative embodiment of an antenna according to the present invention.

Turning to FIG. 3, in an alternative embodiment 58 of the invention, the antenna 10 further includes a first, intermediate balanced transmission line 60 of predetermined length $L_1$ between the front elongate element 12 and the front end of the phasing transmission line 32, and a second intermediate transmission line 62 of length $L_2$, between the rear elongate element 14 and the rear end of the phasing transmission line 32. In this case, the feed point of the front elongate element and the feed point of the rear elongate element are separated by a predetermined distance D'. This embodiment permits the elements to be shorter and may be tuned over a wider range of operating frequencies than the preferred embodiment, but it is slightly more difficult to construct.

It has been found that workable dimensions for the preferred embodiment of an antenna according to invention: (1) 0.118 wavelengths for the spacings D, in the preferred embodiment; (2) 0.478 wavelengths for the length of the front elongate element 12; and (3) 0.506 wavelengths for the length of the rear elongate element 14. However, it is to be recognized that other dimension may be used without departing from the principles of the invention. Moreover, it is to be recognized that in the alternative embodiment of FIG. 3, the element lengths and spacings will vary depending on how much element length is traded off for intermediate balanced transmission lines 60 and 62.

Figure 4:
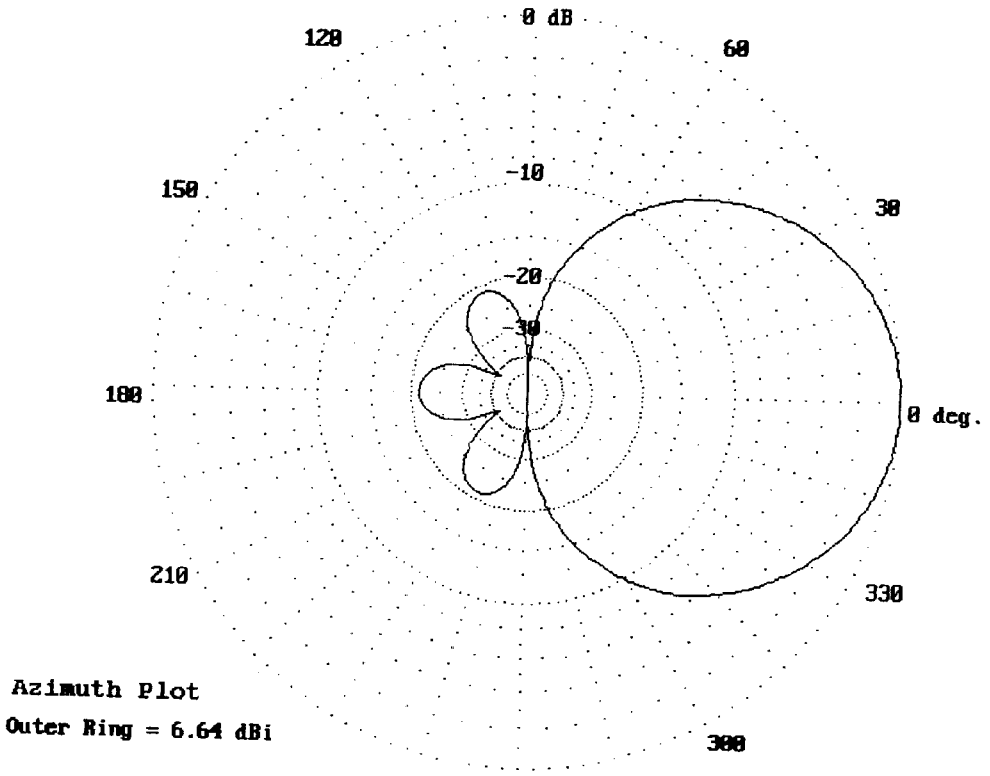
FIG. 4 is typical azimuthal radiation pattern of an antenna according to the present invention.

A typical azimuthal radiation pattern for an antenna according to the present invention in free space is shown in FIG. 4. It can be seen that at a frequency of 10.115 MHz the antenna produces a nominal gain of 6.64 dBi, a nominal front-to-back power ratio of 20.90 dB, and a nominal beam width of 69 degrees.

One important feature of an antenna according to the invention is that tuning of the nominal resonant frequency of the antenna using the shorting member 45 of the variable transmission line 43 has negligible effect on the impedance match obtained using the shorting member 58 of the balun network, and vice-versa. Another important feature is that the rear shorting stub and combined balun and matching network may be folded back along the boom, so that they can be reached and adjusted by a person who has climbed the antenna mast. This means that the antenna may be mounted on a mast and thereafter adjusted in situ to account for interaction with its in situ environment. Thus, compensation for variations in mounting height above the ground and the affect of local surroundings can be adjusted when the antenna is in place by changing the position of the shorting members 45 and 58.

An antenna according to the invention can provide simultaneously a front-to-rear ratio of at least 20 dB and gain in excess of 6.5 dBi. The phasing transmission line may be located inside a metallic boom to provide environmental and mechanical protection. The combined balun and impedance matching network both prevents radiation from an unbalanced feed line, such as coaxial cable, and ensures that the antenna impedance may be matched exactly to 50+j0 ohms. Both the operating frequency and the impedance match may be adjusted independently by means of simple sliding shorts which are accessible from the antenna support mast when the antenna is installed at its intended operating height. This makes compensation for interaction with the in situ environment or the effects of array stacking not only possible, but convenient. The feed and phasing system imposes no inherent limitation on power handling capability.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. An array antenna having an antenna feed point, comprising:

a first elongate element having a feed point gap disposed substantially at the center thereof;

a second elongate element having a feed point gap disposed substantially at the center thereof, said second elongate element being substantially coplanar and parallel with said first elongate element and spaced a predetermined distance therefrom;

a phasing transmission line connected at a first end thereof to said feed point gap of said first elongate element and at a second end thereof to said feed point gap of said second elongate element; and a tuning transmission line connected at one end thereof to said second end of said phasing transmission line, said first end of said phasing transmission line being the feed point for said antenna.

2. The antenna of claim 1, wherein said tuning transmission line includes a movable member for shorting one side of said tuning transmission line to the other side thereof for tuning the resonant frequency of said antenna.

3. The antenna of claim 1, further comprising a balun network having a balanced output port connected to said first end of said phasing transmission line and an unbalanced input port.

4. The antenna of claim 3, wherein said first end of said phasing transmission line is connected to said feed point gap of said first elongate element through a first balanced transmission line of predetermined length, and said second end of said phasing transmission line is connected to said feed point gap of said second elongate element through a second balanced transmission line of predetermined length.

5. The antenna of claim 3, wherein said balun network includes a movable conductive member for matching the impedance of a transmission line connected to said input port to the impedance at said feed point of said antenna.

6. The antenna of claim 3, wherein said balun network comprises a tubular, elongate conductor connected at one end thereof to one side of said feed point of said antenna and at the other end thereof to the other side of said feed point of said antenna, said tubular conductor having an axis and an aperture located substantially half the distance between the ends thereof, and an elongate center conductor disposed substantially along the axis of one half of said tubular conductor, a first end of said center conductor extending out one end of said tubular conductor and being connected to the other end of said tubular conductor, the second end of said center conductor extending out of said aperture in said tubular conductor, the two ends of said tubular conductor being said output port of said balun network, and said tubular conductor at said aperture and said second end of said center conductor being said input port of said balun network.

7. The antenna of claim 6, further comprising a movable member for shorting one half of said tubular conductor to the other half thereof at a selected location between said output port of said balun and said input port of said balun for matching the impedance of a transmission line connected to said input port to the impedance at said feed point of said antenna.

8. The antenna of claim 7, wherein said tuning transmission line includes a movable member for shorting one side of said tuning transmission line to the other side thereof for tuning the resonant frequency of said antenna.

9. The antenna of claim 7, wherein said phasing transmission line comprises a first coaxial element having an inner conductor and an outer conductor, and a second coaxial element having an inner conductor and an outer conductor, said inner conductor of said first coaxial element being connected at said first end of said phasing transmission line to one side of said feed point gap of said first elongate element and at the second end of said phasing transmission line to the opposite side of said feed point gap of said second elongate element, and said inner conductor of said second coaxial element being connected at said first end of said phasing transmission line to the other side of said feed point gap of said first elongate element and at the second end of said phasing transmission line to the opposite side of said feed point gap of said second elongate element, the outer conductors of both said first and second coaxial elements being connected to ground at both ends of said phasing transmission line.

10. The antenna of claim 9, wherein said first end of said phasing transmission line is connected to said feed point gap of said first elongate element through a first balanced transmission line of predetermined length, and said second end of said phasing transmission line is connected to said feed point of said second elongate element through a second balanced transmission line of predetermined length.

11. The antenna of claim 7, wherein said first and second elongate elements are supported by an elongate boom disposed substantially perpendicular to said first and second elongate elements, said phasing transmission line being disposed within said boom.

12. The antenna of claim 1, wherein said first end of said phasing transmission line is connected to said feed point gap of said first elongate element through a first balanced transmission line of predetermined length, and said second end of said phasing transmission line is connected to said feed point of said second elongate element through a second balanced transmission line of predetermined length.

13. The antenna of claim 1, wherein said phasing transmission line comprises a first coaxial element having an inner conductor and an outer conductor, and a second coaxial element having an inner conductor and an outer conductor, said inner conductor of said first coaxial element being connected at said first end of said phasing transmission line to one side of said feed point gap of said first elongate element and at the second end of said phasing transmission line to the opposite side of said feed point gap of said second elongate element, and said inner conductor of said second coaxial element being connected at said first end of said phasing transmission line to the other side of said feed point gap of said first elongate element and at the second end of said phasing transmission line to the opposite side of said feed point gap of said second elongate element, the outer conductors of both said first and second coaxial elements being connected to ground at both ends of said phasing transmission line.

14. A method for electromagnetically coupling a radio to free space, comprising:

providing a first elongate conductive element having a feed point gap disposed substantially at the center thereof, providing a second elongate conductive element having a feed point gap disposed substantially at the center thereof and orienting said second elongate conductive element so as to be substantially coplanar and parallel with said first elongate conductive element and spaced a predetermined distance therefrom;

coupling the radio to said feed point gap of said first elongate conductive element;

coupling the radio to said feed point gap of said second elongate conductive element so that the current at said feed point gap of said second elongate conductive element is out of phase with the current at said feed point gap of said first elongate conductive element; and coupling a tuning transmission line at one end thereof to said feed point gap of said second elongate conductive element.

15. The method of claim 14, further comprising placing a shorting member across said tuning transmission line to optimize said coupling at a selected radio frequency.

16. The method of claim 14, wherein said coupling of said second elongate conductive element to said radio is done by connecting said second elongate conductive element by a transmission line to the feed point of said first elongate conductive element.

17. The method of claim 16, further comprising providing a balun network between said first elongate conductive element and the radio.

18. The method of claim 17, wherein said balun comprises two parallel coupling conductors, said method further comprising placing a shorting member across said parallel coupling conductors to match the impedance of said antenna to the impedance of a transmission line.

* * * * *